US010704739B2

(12) United States Patent
Guo et al.

(10) Patent No.: US 10,704,739 B2
(45) Date of Patent: Jul. 7, 2020

(54) NATURAL GAS TEMPERATURE AND PRESSURE REGULATING SYSTEM BASED ON RECOVERING PRESSURE ENERGY AND ABSORBING HEAT FROM ULTRALOW TEMPERATURE AMBIENT ENVIRONMENT

(71) Applicant: Dalian University of Technology, Dalian (CN)

(72) Inventors: Xiangji Guo, Dalian (CN); Bo Zhang, Dalian (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 0 days.

(21) Appl. No.: 16/479,835

(22) PCT Filed: Dec. 11, 2017

(86) PCT No.: PCT/CN2017/115476

§ 371 (c)(1),
(2) Date: Jul. 22, 2019

(87) PCT Pub. No.: WO2019/090885

PCT Pub. Date: May 16, 2019

(65) Prior Publication Data

US 2020/0072418 A1 Mar. 5, 2020

(30) Foreign Application Priority Data

Nov. 9, 2017 (CN) ..... 2017 1 1096896

(51) Int. Cl.

| | |
|---|---|
| ***F17D 1/02*** | (2006.01) |
| ***F17D 3/01*** | (2006.01) |
| ***F25B 9/04*** | (2006.01) |

(52) U.S. Cl.
CPC ..... *F17D 1/02* (2013.01); *F17D 3/01* (2013.01); *F17C 2221/033* (2013.01); (Continued)

(58) Field of Classification Search
CPC ..... F17D 1/02; F17D 3/01; F17C 2221/033; F17C 2223/0161; F17C 2225/0123; F25B 9/04
See application file for complete search history.

(56) References Cited

U.S. PATENT DOCUMENTS 5,413,227 A * 5/1995 Diebold ..... B01J 19/2405 209/11

FOREIGN PATENT DOCUMENTS

| | | |
|---|---|---|
| CN | 201547496 U | 8/2010 |
| CN | 103075833 A | 5/2013 |

(Continued)

*Primary Examiner* — Kun Kai Ma
(74) *Attorney, Agent, or Firm* — Muncy, Geissler, Olds & Lowe, P.C.

(57) ABSTRACT

The natural gas temperature and pressure regulating system based on recovering pressure energy and absorbing heat from ultralow temperature ambient environment. A pressure driven heating system of pipeline natural gas pressure regulation or liquid natural gas regasification process. This system adopts vortex tube, ambient air heat exchanger and ejector that constitute the pressure driven heating unit to replace the existing heater. The two kinds of pressure driving devices of an ejector and a vortex tube are adopted, transmit the low temperature NG at the cold end of the vortex tube into the ambient air heat exchanger to absorb heat from the ambient continuously; at the same time, make temperature of the gas from the hot end of the vortex tube increase to meet the required temperature of pipeline directly, then achieve the purpose of no heater energy consumed.

1 Claim, 2 Drawing Sheets

(52) U.S. Cl.
CPC ..... *F17C 2223/0161* (2013.01); *F17C 2225/0123* (2013.01); *F25B 9/04* (2013.01)

(56) References Cited

FOREIGN PATENT DOCUMENTS

| | | | |
|---|---|---|---|
| CN | 103382930 | A | 11/2013 |
| CN | 204372553 | U | 6/2015 |
| WO | WO-03/095890 | A1 | 11/2003 |

* cited by examiner

NATURAL GAS TEMPERATURE AND PRESSURE REGULATING SYSTEM BASED ON RECOVERING PRESSURE ENERGY AND ABSORBING HEAT FROM ULTRALOW TEMPERATURE AMBIENT ENVIRONMENT

TECHNICAL FIELD

The invention belongs to the field of natural gas, including pipeline natural gas (PNG), compressed natural gas (CNG) and liquefied natural gas (LNG). The system can recover the residual energy of inflow pressure to realize the compensation pressure regulation and temperature regulation of heat demand in ultra-low temperature environment.

BACKGROUND

Natural gas is a kind of high calorific and clean energy. With the increasingly serious environmental pollution and the discovery and development of a large number of gas fields, natural gas accounts for a higher proportion in the global energy market. Natural gas can be transported in a variety of ways, such as liquefied natural gas (LNG), canned compressed natural gas (CNG) and pipeline compressed natural gas (PNG). Its core is to increase the density (liquid or high-pressure gas) to enhance the efficiency of transportation.

Pipeline natural gas (including associated gas produced from oil field) from the mine field or treatment plant is transported to the city gas distribution center or the tube of industrial enterprise users, which is also called gas pipeline. Natural gas that is transported over long distances in pipelines is called pipeline natural gas (PNG). In the process of long-distance natural gas pipeline transportation, the transportation cost can be reduced due to the increase of gas pressure. The pipeline design transport pressure is generally around 10 Mpa or even higher. Compressed natural gas (CNG) is low-pressure natural gas compressed to 20-25 MPa then send into a set of high-pressure-resistant gas cylinders or pipe bundles by compressor. The effect of compression is to increase its density. It allows more natural gas to be transported and is more suitable for long-distance transportation to instead of long-distance pipeline transportation. The main component of natural gas is methane. When the temperature drops down to about −162° C. at the atmospheric pressure, the gas turn to liquid state, referred to as Liquid Natural Gas (LNG). Since the density of LNG is about 625 times to natural gas at standard state, LNG takes many advantages such as easier storage and transportation, high safety, low investment and environmental-friendly. With the popularity of natural gas, many cities have set up large LNG city gate stations to receive, gasify, odorizing, metering and distribute natural gas for natural gas is gaseous state when it is used.

Problem Analysis

Gaseous high pressure natural gas needs to be decompressed before being sent to the final users, whether transported by PNG or canned CNG, due to it is low-pressure state when used by users, and only the pressure drop to city pipe network allowed pressure 0.1-0.4 MPa can it enter the pipeline. However, the temperature of high pressure natural gas will rapidly decrease during the decompression process due to Joule-Thomson effect, and will absorb a large amount of heat from the ambient environment. If this heat is not replenished in time, the hydrate will form and even form the ice-blocking in the valve and pipelines, damage the pipelines and its associated valve. Temperature of the natural gas are raised to a certain degree, and then enter the pressure regulating device to adjust the pressure, so that during the process of pressure regulating and cooling, the natural gas will not come to the freezing point. Basically there are two kinds of heating devices, one consumes electrical energy such as electrical heating or electrical heat tracing system; the other consumes gas such as hot water boiler circulation heating system. Both of the two heating systems require a significant amount of energy to the natural gas depressurization process. In the existing CNG storage tanks or incoming PNG, the high pressure natural gas is directly decompressed in the pressure regulating device of the gas distribute station or the gas decompress station, and this part of huge pressure energy is wasted.

For the LNG re-gasified process which use ambient air vaporizer, except the vaporizer, another heater is also required to heat the low-temperature gas that does not meet the required temperature of the pipeline. Under non-working conditions, LNG is stored in the tank of low temperature and standard pressure, and under working conditions, the tank with a supercharger pressurize the LNG in the storage tank, and the LNG is driven to ambient air vaporizer by pressure difference. In the ambient air vaporizer, the LNG exchanges heat with the air from external environment, then phase changes, and vaporizes into gaseous state with the temperature rises. When the ambient temperature is high in the summer, the temperature of the natural gas at the outlet of the ambient air vaporizer can be increased to 5° C. or even more, it is decompressed by the pressure regulating device directly and enter into the city pipeline sent to various users. In the winter or rainy season, due to the effect of lower ambient temperature or humidity, the efficiency of the ambient air vaporizer is reduced. When the natural gas temperature does not reach the required temperature of the pipeline, to prevent the low-temperature embrittlement and avoid the overlarge quantity difference between supply and marketing by the large density of low temperature natural gas. The low-temperature natural gas after vaporization needs to be heated to the required temperature of the pipeline by the heater, and finally goes to the city pipe network after metering and odorizing. According to different heat sources, heaters can be divided into combustion heating type, hot water heating type and electric heating type, etc. The existing natural gas regasification heating process requires a large amount of energy to heat the low temperature NG.

To sum up, although the existing process of LNG regasification absorbs ambient heat by ambient air vaporization, it is still subject to the fact that it cannot achieve effective heat absorption at lower ambient temperature conditions; The pressure regulating process of CGN/PNG often uses electric heating. With the natural gas utilization increase sharply in the city, the amount of heat consumed in the above two processes is extremely considerable. Therefore, it is urgent to increase the ability of recover heat from the ambient (especially the atmosphere) through system innovation and recovering the potential energy of the system and improve energy efficiency during using natural gas.

This invention aims at the heating process of pressure regulation of pipeline and compressed natural gas and regasification of liquid natural gas, through analysis, proposes a cycle formed by ejector-vortex tube-ambient air heat exchanger in the existing natural gas decompression/regasification process. Achieve to extract heat from ultra-low temperature ambient, and replace the existing water bath or electric heating process. The ejector-vortex tube can be driven by the high pressure difference from the pressure regulating process of pipeline or compressed natural gas, or the temperature and pressure rise in the regasification process of liquid natural gas, reduce the heat extraction temperature of the ambient air heat exchanger and realize to extract heat from ultra-low temperature ambient, and compensates the heat required in the decompression process of high pressure natural gas and regasification process of liquid natural gas, and does not consume electricity or fuel, so that the energy efficiency of the existing natural gas distribution station, decompression station and regasification station can be improved dramatically.

SUMMARY

In view of the existing technical problems, the invention provides a pipeline natural gas decompression or gasification system which realizes low temperature air heating by utilizing the self-pressure of incoming natural gas or pressurization during LNG vaporization. This system adopts vortex tube, ambient air heat exchanger and ejector that constitute the pressure driven heating unit to replace the existing heater. (For LNG, a cryogenic liquid booster pump is installed between the storage tank and the ambient air vaporizer to increase the NG pressure at outlet of the ambient air vaporizer). The two kinds of pressure driving devices of an ejector and a vortex tube are adopted, transmit the low temperature NG at the cold end of the vortex tube into the ambient air heat exchanger to absorb heat from the ambient continuously; at the same time, make temperature of the gas from the hot end of the vortex tube increase to meet the required temperature of pipeline directly, then achieve the purpose of no heater energy consumed. The core is to use the energy separation effect of vortex tube to generate high and low temperature airflow. The high temperature airflow enters the pipe network of users directly, and the low temperature airflow has the ability to absorb heat from the ultra-low temperature ambient atmosphere; the injector realizes the NG which is discharged into the ambient air heat exchanger to reenter the vortex tube after absorbing atmospheric heat. The two matching and work under the pressure of the incoming natural gas.

The solution of the invention to solve technical problems is as follows:

A pipeline natural gas decompression/gasification system that utilizes the pressure of incoming flow natural gas (or supercharged during LNG vaporization) achieve low temperature air heat extraction, including high pressure incoming natural gas, pressure regulating device, vortex tube, ambient air heat exchanger and ejector. The inflow high-pressure natural gas includes compressed natural gas (CNG), pipeline natural gas (PNG) and liquefied natural gas (LNG).

Liquid natural gas has low pressure and low temperature in the storage tank. Therefore, it is necessary to arrange a booster pump to raise the pressure head of LNG before entering the ambient air vaporizer, then heated and vaporized to become higher pressure gaseous natural gas by ambient air vaporizer. While the pipeline and compressed natural gas are high pressure gas during storage and transportation, no boosting is required. On this basis, the high pressure natural gas enter the pressure regulating device after heated, vaporized/decompressed through a pressure-driven heating pressure regulating unit.

The pressure-driven heating pressure regulating unit is composed of a vortex tube, an ambient air heat exchanger and an ejector, these devices connected sequentially to form a closed loop. The cold end of vortex tube is connected to the ambient air heat exchanger, and the hot end of vortex tube is connected to the pressure regulating device. The outlet of ejector is connected to the inlet of vortex tube.

The high pressure natural gas of primary stream and the low-pressure natural gas discharged from the ambient air heat exchanger are mixed in the ejector to form a stream at medium pressure and then enter the vortex tube from the outlet of ejector; through the tangential nozzle of vortex tube the pressure is decompressed and high speed vortex is formed due to the energy separation effect of vortex tube, the natural gas is separated into two streams, one is heated by the heating effect of vortex tube, and adjusted to the pipeline allowed temperature by the control valve of hot end, then sent to the pressure regulating device. The other is discharged from the cold end of vortex tube and transmitted into the ambient air heat exchanger to absorb heat from atmosphere; the natural gas discharged from the outlet of the ambient air heat exchanger is injected into the injector by the high-speed jet.

The natural gas discharged from the hot end of the vortex tube enters the pressure regulating device to reduce pressure, finally reaches the allowed pressure and enters into the city pipe network or downstream of distribution station.

The Beneficial Effects of this Invention

This invention recovers the pressure energy of natural gas by means of injector pressure driving and the circular flow in the ejector, the cold end of vortex tube and the ambient air heat exchanger. Due to the refrigeration capacity of the cold end of vortex tube, the temperature of a part of natural gas from the inlet of vortex tube is further reduced. After passing the ambient air heat exchanger, the low-temperature and low-pressure natural gas can absorb heat from the atmosphere to increase the temperature continuously. The heating capacity of the hot end of vortex tube allows the other portion of natural gas to be heated and then transmitted to the downstream of distribution station or the city pipe network. At the same time, in the process of heating the high pressure pipeline natural gas pressure reduction is realized, achieve the purpose of heating and decompressing of the high pressure natural gas at the same time without consuming electric energy or heating by the water bath, greatly reducing the energy required to heat the high pressure natural gas from pipeline. This invention can be applied to decompress CGN and PNG at various stages, and obtain heat from the ambient atmosphere to compensate the heat in the decompression process, and can be applied to LNG regasification stations absorb heat from the atmosphere under low temperature conditions, to compensate the heat of LNG regasification process, which can realize energy conservation and environment protection significantly.

Figure 3:
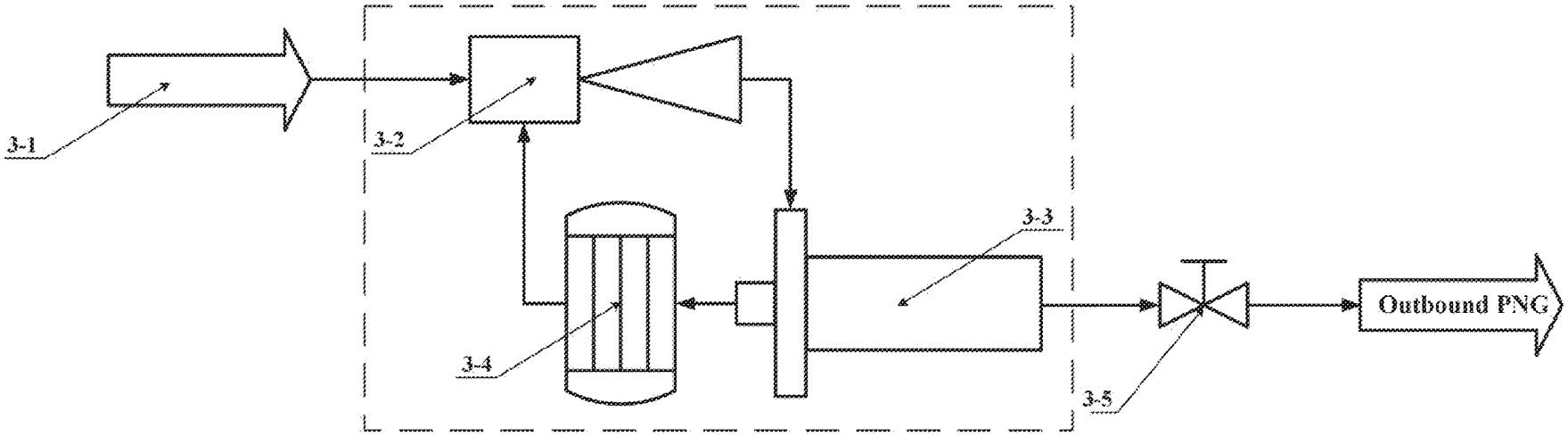

In the diagram: 2-1 CNG Storage tank; 2-2 ejector; 2-3 ambient air heat exchanger; 2-4 vortex tube; 2-5 pressure regulating device FIG. 3 Schematic diagram of the system of this invention at the PNG decompression/distribution station.

Figure 4:
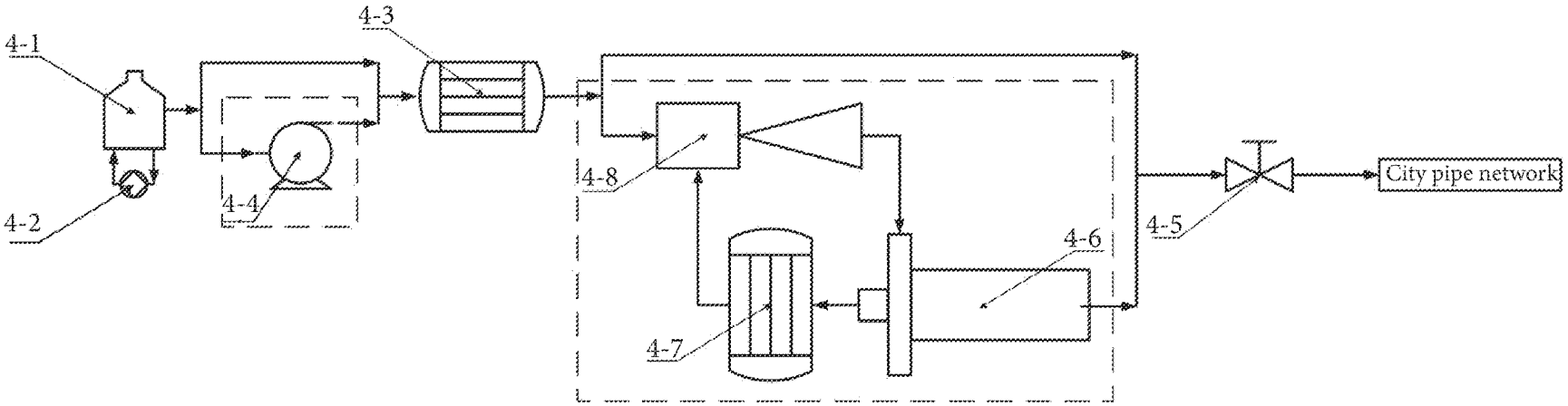

In the diagram: 3-1 incoming flow PNG; 3-2 ejector; 3-3 vortex tube; 3-4 ambient air heat exchanger; 3-5 downstream pressure regulating FIG. 4 Schematic diagram of the system of this invention at the LNG decompression station.

In the diagram: 4-1 LNG Storage tank; 4-2 LNG Storage tank with supercharger; 4-3 ambient air vaporizer; 4-4 cryogenic liquid booster pump; 4-5 pressure regulating device; 4-6 vortex tube; 4-7 ambient air heat exchanger; 4-8 ejector;

DETAILED DESCRIPTION

Specific implementation method of this invention are described in detail combined with the technical solutions and the accompanying diagram.

Natural gas pressure regulating system using pressure of the incoming flow natural gas and absorbing heat from ultralow temperature ambient environment, which is mainly consisted of vortex tube 1-1, ambient air heat exchanger 1-2 and ejector 1-3.

The incoming high pressure natural gas enters the heating and pressure regulating system that driven by pressure at this invention.

This pressure driven heating and pressure regulating unit is consisted of ejector 1-3, vortex tube 1-1, ambient air heat exchanger 1-2, they are connected sequentially to form a closed loop. The cold end of vortex tube 1-1 is connected to the ambient air heat exchanger 1-2, and the hot end of vortex tube 1-1 flows out of the system into the subsequent device; the high pressure incoming natural gas enters into the ejector 1-3 and becomes the main working fluid. The fluid expands and accelerates in the Laval nozzle in the injector 1-3 to form a supersonic jet that injects the low pressure natural gas discharged from the outlet of the ambient air heat exchanger 1-2, the two stream of natural gas exchange momentum and energy to become one stream in the mixing chamber of ejector 1-3, and then the stream experiences pressure recovery in the diffuser of ejector 1-3, and a medium-pressure fluid is formed at the outlet of ejector 1-3, and then transmit the stream into the vortex tube 1-1; After the natural gas enters the vortex tube 1-1, it expands and decompresses through the tangential nozzle in the vortex tube 1-1 to form a high-speed vortex. Due to the energy separation effect of the vortex tube 1-1, the natural gas is separated into two streams. One is heated by the heating effect of the vortex tube 1-1, and the temperature is adjusted to the allowed temperature of the pipe network through control valve at the hot end of vortex tube and then enter the subsequent downstream device; due to the cooling effect inside of the vortex tube 1-1, the other stream is cooled and enters into ambient air heat exchanger 1-2 through the cold end of vortex tube 1-1 to absorb heat from air, then the heated natural gas is discharged from the outlet of the ambient air heat exchanger 1-2, and return to the ejector 3 from the injecting fluid inlet of the injector 1-3.

Based on the system above, three specific implementation solutions are listed below for different incoming natural gas conditions.

(1) The Incoming Flow is Compress Natural Gas (CNG)

When the application background is compressed natural gas, the decompression system that can use the pressure of the storage tank itself to achieve the heat extraction from low temperature air, mainly consisted of 2-1 CNG storage tank; 2-2 ejector; 2-3 ambient air heat exchanger; 2-4 vortex tube; 2-5 pressure regulating device.

The compressed natural gas transported from the CNG storage tank 2-1 into the heating pressure regulating unit driven by pressure described in this invention, and then is transmitted to the pressure regulating device 2-5;

The pressure driven heating and pressure regulating unit is consisted of an ejector 2-2, a vortex tube 2-4, and an ambient air heat exchanger 2-3, they are connected sequentially to form a closed loop, the cold end of the vortex tube 2-4 is connected to the ambient air heat exchanger 2-3, and the hot end of the vortex tube 2-4 is connected to the pressure regulating device 2-5; the high pressure natural gas discharged from the CNG storage tank 2-1 enters the ejector 2-2 and becomes main working fluid. The fluid expands and accelerates in the Laval nozzle in the injector 2-2 to form a supersonic jet that injects the low pressure natural gas discharged from the outlet of the ambient air heat exchanger 2-3, the two stream of natural gas exchange momentum and energy to become one stream in the mixing chamber of ejector 2-2, and then the stream experiences pressure recovery in the diffuser of ejector 2-2, and a medium-pressure fluid is formed at the outlet of ejector 2-2, and then transmit the stream into the vortex tube 2-4; After the natural gas enters the vortex tube 2-4, it expands and decompresses through the tangential nozzle in the vortex tube 2-4 to form a high-speed vortex. Due to the energy separation effect of the vortex tube 2-4, the natural gas is separated into two streams. One is heated by the heating effect of the vortex tube 2-4, and the temperature is adjusted to the allowed temperature of the pipe network through control valve at the hot end of vortex tube 2-4 and then enter the subsequent downstream device 2-5; due to the cooling effect inside of the vortex tube 2-4, the other stream is cooled and enters into ambient air heat exchanger 2-3 through the cold end of vortex tube 2-4 to absorb heat from air, then the heated natural gas is discharged from the outlet of the ambient air heat exchanger 2-3, and return to the ejector 2-2 from the injecting fluid inlet of the injector 2-2.

(2) The Incoming Flow is Pipeline Natural Gas (PNG)

The high pressure natural gas that has been transported into the distribution station or the city gate station from the incoming PNG 3-1 enters the heating and pressure regulating unit driven by pressure described in this invention, and then is transmitted to the pressure regulating device 3-5.

The pressure driven heating and pressure regulating unit is consisted of an ejector 3-2, a vortex tube 3-3, and an ambient air heat exchanger 3-4, they are connected sequentially to form a closed loop, the cold end of the vortex tube 3-3 is connected to the ambient air heat exchanger 3-4, and the hot end of the vortex tube 3-3 is connected to the pressure regulating device 3-5; the high pressure natural gas discharged from the incoming flow PNG 3-1 enters the ejector 3-2 and becomes main working fluid. The fluid expands and accelerates in the Laval nozzle in the injector 3-2 to form a supersonic jet that injects the low pressure natural gas discharged from the outlet of the ambient air heat exchanger 3-4, the two stream of natural gas exchange momentum and energy to become one stream in the mixing chamber of ejector 3-2, and then the stream experiences pressure recovery in the diffuser of ejector 3-2, and a medium-pressure fluid is formed at the outlet of ejector 3-2, and then transmit the stream into the vortex tube 3-3; After the natural gas enters the vortex tube 3-3, it expands and decompresses through the tangential nozzle in the vortex tube 3-3 to form a high-speed vortex. Due to the energy separation effect of the vortex tube 3-3, the natural gas is separated into two streams. One is heated by the heating effect of the vortex tube 3-3, and the temperature is adjusted to the allowed temperature of the pipe network through control valve at the hot end of vortex tube 3-3 and then enter the subsequent downstream device 3-5; due to the cooling effect inside of the vortex tube 3-3, the other stream is cooled and enters into ambient air heat exchanger 3-4 through the cold end of vortex tube 3-3 to absorb heat from air, then the heated natural gas is discharged from the outlet of the ambient air heat exchanger 3-4, and return to the ejector 3-2 from the injecting fluid inlet of the injector 3-2.

(3) The Incoming Flow is Liquid Natural Gas (LNG)

Figure 1:
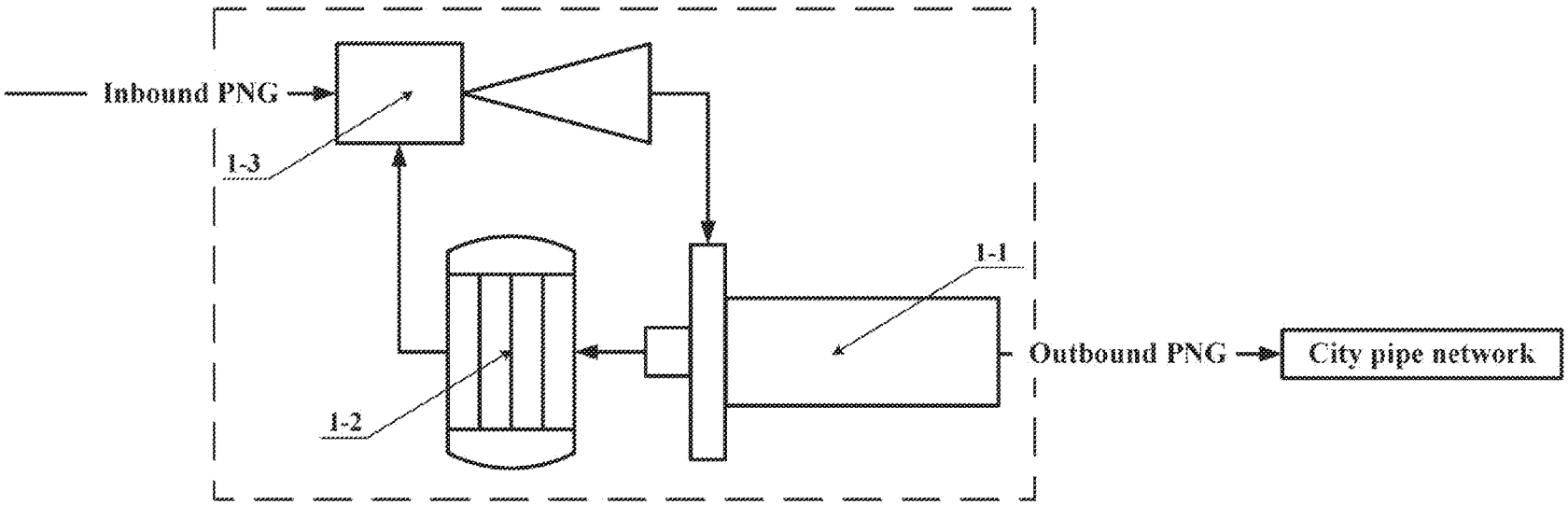
FIG. 1 Schematic diagram of the natural gas temperature and pressure regulating system based on recovering pressure energy and absorbing heat from ultralow temperature ambient environment In the diagram: 1-1 vortex tube; 1-2 ambient air heat exchanger; 1-3 ejector.
Figure 2:
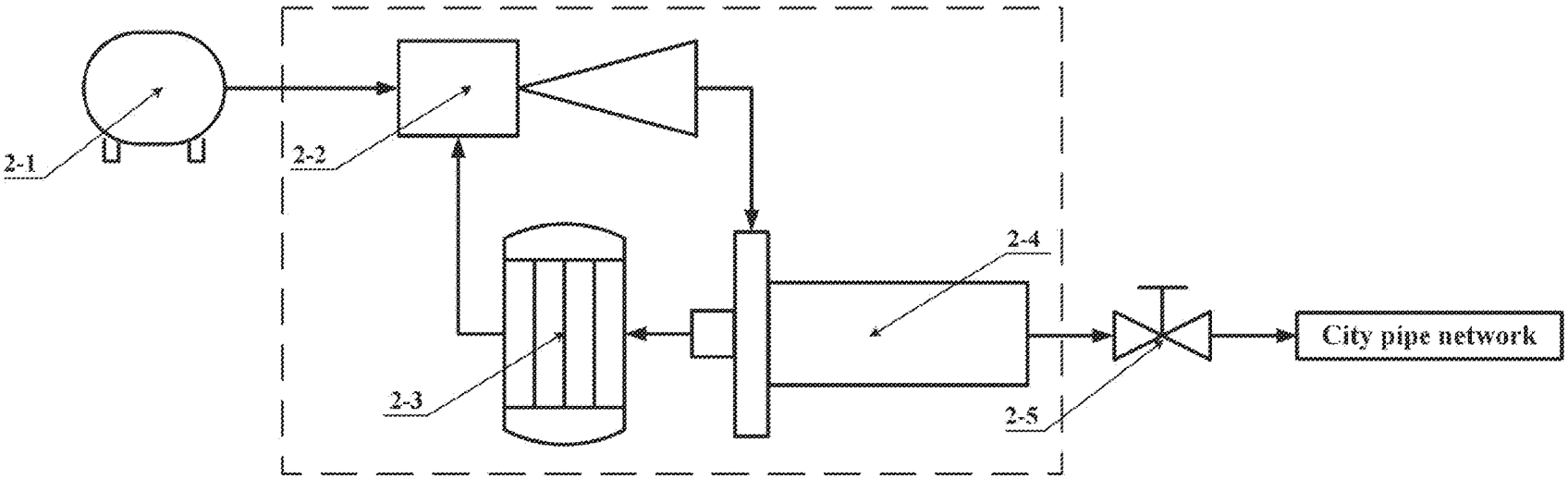
FIG. 2 Schematic diagram of the system of this invention at the CNG decompression station.

As shown in FIG. 2, a pressure driven liquid natural gas regasification heating system of the this invention is mainly consisted of an LNG storage tank 4-1 with a supercharger 4-2, and an ambient air vaporizer 4-3, a cryogenic liquid booster pump 4-4, a pressure regulating device 4-5, a vortex tube 4-6, an ambient air heat exchanger 4-7, and an ejector 8.

After the LNG exchanges heat with air in the ambient air vaporizer 4-3, the LNG converts into gaseous because of phase changing, and the temperature is raised. When the temperature meets the allowed temperature of pipe network after being heated by the ambient air vaporizer 4-3, then enter the pressure regulating device 4-5 directly; while the natural gas vaporized by the ambient air vaporizer 4-3 fails to reach the allowed temperature of the pipe network, the cryogenic liquid booster pump 4-4 is started. After pressurization, the natural gas is discharged from the ambient air vaporizer 4-3 and enters the pressure driven heating unit then is transmitted to the pressure regulating device 4-5;

The pressure driven heating unit described in this invention is consisted of an ejector 4-8, a vortex tube 4-6, and an ambient air heat exchanger 4-7, they are connected sequentially to form a closed loop, the cold end of the vortex tube 4-6 is connected to the ambient air heat exchanger 4-7, and the hot end of the vortex tube 4-6 is connected to the pressure regulating device 4-5; the high pressure natural gas discharged from the ambient air vaporizer 4-3 enters the ejector 4-8 and becomes main working fluid. The fluid expands and accelerates in the Laval nozzle in the injector 4-8 to form a supersonic jet that injects the low pressure natural gas discharged from the outlet of the ambient air heat exchanger 4-7, the two stream of natural gas exchange momentum and energy to become one stream in the mixing chamber of ejector 4-8, and then the stream experiences pressure recovery in the diffuser of ejector 4-8, and a medium-pressure fluid is formed at the outlet of ejector 4-8, and then transmit the stream into the vortex tube 4-6; After the natural gas enters the vortex tube 4-6, it expands and decompresses through the tangential nozzle in the vortex tube 4-6 to form a high-speed vortex. Due to the energy separation effect of the vortex tube 4-6, the natural gas is separated into two streams. One is heated by the heating effect of the vortex tube 4-6, and the temperature is adjusted to over 5° C. through control valve at the hot end of vortex tube 4-6 and then enter the subsequent downstream device 4-5; due to the cooling effect inside of the vortex tube 4-6, the other stream is cooled and enters into ambient air heat exchanger 4-7 through the cold end of vortex tube 4-6 to absorb heat from air, then the heated natural gas is discharged from the outlet of the ambient air heat exchanger 4-7, and return to the ejector 4-8 from the injecting fluid inlet of the ejector 4-8.

According to the mass conservation of the inlet and outlet, the pressure-driven heating unit proposed by the invention is systematically analyzed. The relationship between the cold flow ratio of the swirl tube and the ejector ejection coefficient is obtained as follows:

$$(1+\lambda)(1-\varepsilon)=1 \text{ or } \varepsilon=1-1/(1+\lambda) \quad (1)$$

Among them, $\varepsilon$ is the cold flow ratio of the vortex tube, defined as the ratio of the mass flow at the outlet of the cold end to the mass flow at the inlet; $\lambda$ is the ejector injection coefficient, defined as the ratio of the mass flow rate of the injected gas to the mass flow rate of the injected gas.

It can be seen from the formula (1) that the cold flow ratio $\varepsilon$ is proportional to the injection coefficient $\lambda$, that is, increasing the injection coefficient can increase the cold flow ratio.

For the vortex tube energy separation performance, for a fixed structure vortex tube, the means for improving the hot end heating capacity of the vortex tube can increase the inlet pressure or increase the cold flow ratio. If the inlet pressure of the vortex tube is increased, since the inlet of the vortex tube 4-6 is connected to the outlet of the ejector 8, the ejector 8 injects fluid requires a large pressure drop in order to ignite the low pressure fluid, and the vortex tube 4-6 is increased under the same injection coefficient. The inlet pressure is bound to increase the injector 8 injection pressure. For the ejector ejector performance, under the condition that the ejector structure is fixed and the ejector fluid condition is constant, the ejector injection coefficient can be increased to increase the injector inlet pressure. In summary, in order to enhance the heating capacity of the hot end of the vortex tube 4-6 and make the outlet gas temperature reach the allowable temperature of the pipeline network, the method of increasing the pressure of the ejector 8 injecting the inlet fluid can be adopted. Therefore, a cryogenic liquid booster pump 4-4 is arranged between the storage tank 4-1 and the air-temperature gasifier 4-3 to boost the cryogenic LNG flowing from the outlet of the storage tank 4-1 so that the pressure of the gaseous natural gas flowing from the outlet of the air-temperature gasifier 4-3 reaches the design pressure value of the ejector 8 ejecting the inlet fluid.

The invention claimed is:

1. A natural gas temperature and pressure regulating system based on recovering pressure energy and absorbing heat from ultralow temperature ambient environment, comprising an inflow high-pressure natural gas and a pressure regulating device;

wherein the natural gas temperature and pressure regulating system comprises a pressure-driven heating and pressure regulating unit; wherein the inflow high-pressure natural gas is heated, gasified or decompressed by the pressure-driven heating and pressure regulating unit and then connected to the pressure regulating device;

the inflow high-pressure natural gas includes compressed natural gas, pipeline natural gas and liquefied natural gas;

the pressure-driven heating and pressure regulating unit consists of a vortex tube, an air-temperature heat exchanger and an ejector; an inlet of the ejector is connected with an outlet of the air-temperature heat exchanger, an outlet of the ejector is connected with an inlet of the vortex tube; a cold end of the vortex tube is connected with an inlet of the air-temperature heat exchanger, and a hot end of the vortex tube is connected with the pressure regulating device;

the inflow high-pressure natural gas and a low-pressure natural gas discharged from the air-temperature heat exchanger are mixed in the ejector to form a medium-pressure natural gas which is then discharged from the outlet of the ejector into the vortex tube; a high-speed vortex is formed after going through a tangential nozzle of the vortex tube and the medium-pressure natural gas is depressed, and the medium-pressure natural gas is separated into two low-pressure streams inside the vortex tube due to an energy separation effect of the vortex tube, one stream from the vortex tube goes to the hot end is heated by the heating action in the vortex tube, and a temperature of the one stream of the low-pressure natural gas is adjusted to an allowable temperature of the pipe network through a hot-end control valve of the vortex tube, and then sent to the pressure regulating device; the other stream of the low-pressure natural gas from the vortex tube goes to a cold-end of the vortex tube, then, enters into the air-temperature heat exchanger to absorb heat from the air; and the low-pressure natural gas from the outlet of the air-temperature heat exchanger is injected into the ejector by a high-speed jet from the ejector;

the natural gas discharged from the hot end of the vortex tube enters the regulating device for pressure reduction, so as to reach a delivery pressure and eventually enter a downstream of a sub-station or an urban pipeline network.

* * * * *